US005560225A

United States Patent [19]

Salucci

[11] Patent Number: 5,560,225

[45] Date of Patent: Oct. 1, 1996

[54] UNIT FOR TRANSMITTING MOTION TO A HOSIERY SUCTION TUBE IN A CIRCULAR KNITTING MACHINE FOR MANUFACTURING HOSIERY

[75] Inventor: Paolo Salucci, Florence, Italy

[73] Assignee: MATEC S.r.l., Scandicci, Italy

[21] Appl. No.: 530,849

[22] Filed: Sep. 20, 1995

[30] Foreign Application Priority Data

Sep. 27, 1994 [IT] Italy ..... BO94A0422

[51] Int. Cl.[6] ..... D04B 15/92

[52] U.S. Cl. ..... 66/149 S; 66/148; 66/149 R

[58] Field of Search ..... 66/149 R, 149 S, 66/147, 148; 192/12 R, 18 B, 18 R, 12 D, 125 A, 129 A, 144

[56] References Cited

U.S. PATENT DOCUMENTS

| | | | |
|---|---|---|---|
| 3,564,875 | 2/1971 | Foreman . | |
| 3,691,859 | 9/1972 | Peters | 192/144 X |
| 3,802,223 | 4/1974 | Wright et al. | 66/149 S X |
| 3,823,582 | 7/1974 | Butler | 66/149 S X |
| 4,242,891 | 1/1981 | Gradi | 66/149 S |
| 5,284,033 | 2/1994 | Lonati et al. | 66/149 S |

FOREIGN PATENT DOCUMENTS

| | | |
|---|---|---|
| 1934730 | 1/1970 | Germany . |
| 2044432 | 3/1971 | Germany . |

*Primary Examiner*—John J. Calvert
*Attorney, Agent, or Firm*—Guido Modiano; Albert Josif

[57] ABSTRACT

A unit is disclosed for transmitting motion to the hosiery suction tube in a circular knitting machine of the type having a fixed supporting plate to which a cylinder support with a vertical axis, an internal hosiery passage tube that is coaxial to the cylinder support, and an underlying perforated tube are rotatably coupled. The unit has respective flanges rigidly coupled below the cylinder support and above the perforated tube and supporting respective pluralities of permanent magnets that are distributed in an annular fashion and constitute a magnetic coupling between the flanges for the rotary actuation of the perforated tube. A collar of a material that has high magnetic reluctance is arranged in the air gap formed between the rings of facing magnets and has a device for rotary coupling to the hosiery passage and a device for selective coupling to said flanges or to said fixed supporting plate for causing or stopping the rotation of the hosiery passage tube.

9 Claims, 2 Drawing Sheets

UNIT FOR TRANSMITTING MOTION TO A HOSIERY SUCTION TUBE IN A CIRCULAR KNITTING MACHINE FOR MANUFACTURING HOSIERY

BACKGROUND OF THE INVENTION

The present invention relates to a unit for transmitting motion to a hosiery suction tube in a circular knitting machine for manufacturing hosiery, i.e., in small-diameter circular knitting machines.

Conventional circular knitting machines for manufacturing hosiery include a needle cylinder and a sinker ring that are coaxial, are made to rotate continuously, and move, within respective slots, needles and sinkers that are actuated in a coordinated manner so as to gradually form a tubular knitted fabric that falls along an internal tube that is coaxial to the cylinder and is known as the hosiery passage tube.

Depending on the type of thread being processed, or due to various kinds of textile requirement (especially in the field of women's hosiery), sometimes the hosiery passage tube must be fixed or must be rotated together with the needle cylinder.

The hosiery item passes through the hosiery passage tube by suction from below, but in cases in which the hosiery passage tube remains fixed while the cylinder rotates, the hosiery tends to become twisted; in this case the hosiery item, which rotates together with the needles in the top part, in fact rubs against the internal surface of the tube, which is kept fixed, and despite the presence of the air stream, beyond a certain length the friction forces against the tube walls, which tend to cause twisting, prevail over the forces of the descending air stream, which would otherwise tend to keep the hosiery item stretched.

In order to obviate this drawback, modern knitting machines have been equipped with a device, known as an "anti-twist" device, that is constituted by a perforated tubular element that is arranged below the hosiery passage tube and coaxially thereto; the suction air passes through said perforated tube, which is rotated at the same speed as the needle cylinder, and the suction of the air through its surface tends to draw the hosiery item against its walls, so as to rigidly couple the hosiery item to a surface that rotates together with the needle cylinder and thus prevents it from becoming twisted.

Transmissions based on gears or belts and driven by the cylinder support or by the motor are usually used to rotate the perforated tube of conventional "anti-twist" devices: such actuation systems have considerable drawbacks, due to noise, difficulty in lubrication, and bulk; even greater costs and drawbacks occur in the case of knitting machines driven by a hollow motor that is coaxial to the cylinder.

In addition to this, it is rather troublesome to change the hosiery passage tube from the rotating condition to the non-rotating condition, or vice versa, and selection can usually be performed only when the machine is not working.

SUMMARY OF THE INVENTION

The aim of the present invention is to obviate the mentioned drawbacks of conventional devices by providing a unit for transmitting motion to the hosiery suction tube in a circular knitting machine for manufacturing hosiery which does not require a belt or gear transmission, which allows to select the rotation or nonrotation mode of the hosiery suction tube even when the machine is working, and which can be installed even on machines having a hollow motor that is coaxial to the cylinder.

This also allows to program the machine so that part of the hosiery item is manufactured while the tube is not moving and another part is manufactured while the tube is moving, with considerable advantages related to the quality of said hosiery item (this is not allowed by conventional machines, since changeover from a fixed tube to a rotating tube requires stopping the machine and changing the configuration, or even requires replacing some components, to pass from one situation to the other).

Within the scope of this aim, an object of the present invention is to achieve the above aim with a structure that is simple, relatively easy to produce in practice, safe in use, effective in operation, and of relatively low cost.

With this aim and object in view, the invention provides a unit for transmitting motion to the hosiery suction tube in a circular knitting machine for manufacturing hosiery of the type that has a fixed supporting plate, to which a cylinder support with a vertical axis, an internal hosiery passage tube that is coaxial to the cylinder support, and an underlying perforated tube are rotatably coupled; characterized in that said hosiery passage tube is provided with means for selective coupling to said rotatable elements or to said fixed supporting plate, said means being adapted to cause or stop the rotation of said hosiery passage tube.

DETAILED DESCRIPTION OF THE DRAWINGS

Further features will become apparent and evident from the detailed description of a preferred but not exclusive embodiment of a unit for transmitting motion to the hosiery suction tube in a circular knitting machine for manufacturing hosiery according to the invention, illustrated only by way of non-limitative example in the accompanying drawings, wherein.

DETAILED DESCRIPTION OF THE PREFERRED EMBODIMENTS

Figure 1:
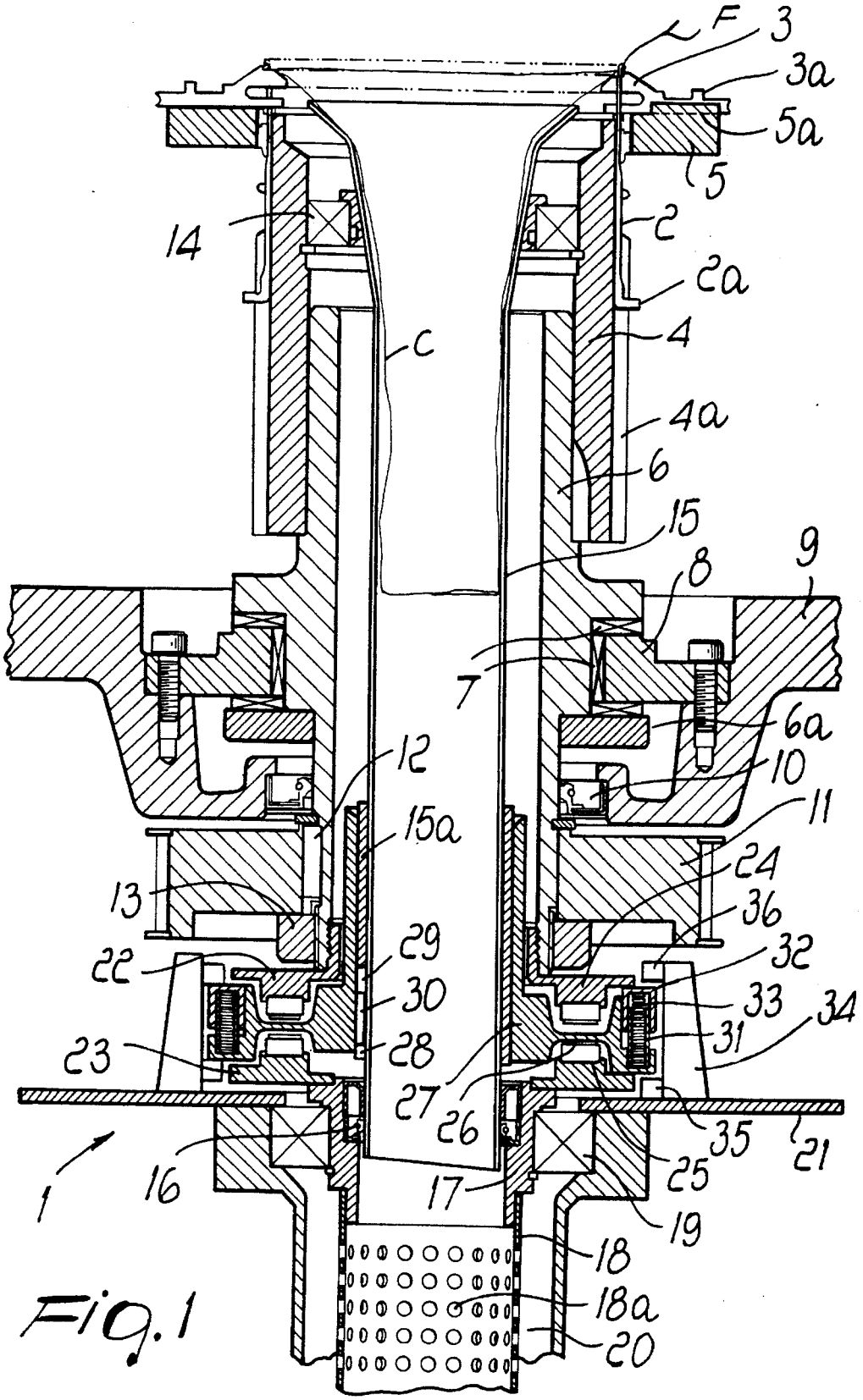
FIG. 1 is a sectional side view, taken along a diametrical plane, of a unit for transmitting motion to the hosiery suction tube in a circular knitting machine.

With reference to the above figures, the reference numeral 1 generally designates the unit for transmitting motion to the hosiery suction tube in a circular knitting machine for manufacturing hosiery according to the invention.

The machine 1 is of the type provided with needles 2 and sinkers 3 slideably mounted in respective slots *4a*, *5a* of a needle cylinder 4 and of a sinker ring 5; said needles and said sinkers, by virtue of the interaction of heels *2a*, *3a* thereof with appropriate fixed-cam profiles, perform a relative motion that ensures engagement of the thread F and formation of a tubular knitted fabric C, or hosiery item, which descends inside the cylinder 4 as it is being formed.

The cylinder 4 is rigidly coupled to a cylinder support 6 that is rotatably supported, by means of bearings 7 and of a disk *6a*, by an annular support 8 that is rigidly coupled, by means of bolts, to a fixed plate 9; a sealing gasket 10 is arranged between the cylinder support 6 and the plate 9, and a driving pulley 11 is keyed on the cylinder support 6 by means of a key 12; a lower ring 13 is also threaded onto the cylinder support 6.

A hosiery passage tube 15 is idly mounted inside the cylinder support by means of a bearing 14 and flares out at the top; said tube is rotatably centered at the bottom, by means of a gasket 16, to the top of a stub 17 that is keyed to the top of a tube 18 with holes 18*a* (a device known as an "anti-twist" device: the tube 18 is rotatably supported, by means of a bearing 19, inside a tubular suction chamber 20 that has a larger diameter and is in turn fixed below a fixed supporting plate 21).

The hosiery passage tube is provided, according to the invention, with means for selective coupling to said rotatable elements or to said fixed supporting plate that are adapted to cause or stop the rotation of said hosiery passage tube.

A flange 22 is threaded below the cylinder support 6, and the flange 23 is fixed above the stub 17 and is rigidly coupled to the perforated tube 18; said flanges support respective pluralities of permanent magnets 24 and 25 that are distributed in an annular fashion and constitute a magnetic coupling between the flanges 22,23 for actuating the rotation of the perforated tube.

A collar 26 of a material that has high magnetic reluctance is arranged in the air gap that is formed between the rings of facing magnets 24 and 25.

A central sleeve 27 is rigidly coupled to the collar 26 and is mounted on a reinforcement 15*a* of the tube 15: the sleeve 27 and the reinforcement 15*a* have respective mutually facing longitudinal slots 28 and 29 for the insertion of a rotary coupling tab 30, which allows longitudinal sliding motions of the collar 26 with respect to the hosiery passage tube.

There are also means for the selective coupling of the collar to the flanges or to the fixed supporting plate 21 to cause or stop the rotation of the tube 15: this can be achieved in various manners, depending on whether the selection is to be made while the machine is running or while the machine is not working.

FIG. 1 shows a unit that allows selection while the machine is running; the collar 26 is peripherally provided with a disk 31, on which a complementary disk 32 is mounted so that it can slide vertically; a plurality of compression springs 33 with vertical axes are clamped between said disks and are adapted to push said disks in mutually opposite directions so as to produce friction coupling against the edges of the flanges 22 and 23 to transmit motion to the tube 15.

A brake 34 is mounted on the plate 21 and has two jaws 35 and 36 that are adapted to clamp the disk 32 and the complementary disk 33 in order to stop the hosiery passage tube and make it fixed: in this manner, without having to stop the machine, by actuating the jaws of the brake 34 it is possible to pass from a condition in which the tube 15 is moving to a condition in which said tube is not moving, and vice versa, whereas motion continues to be imparted to the perforated tube 18 by means of the permanent-magnet coupling 24–25.

Figure 2:
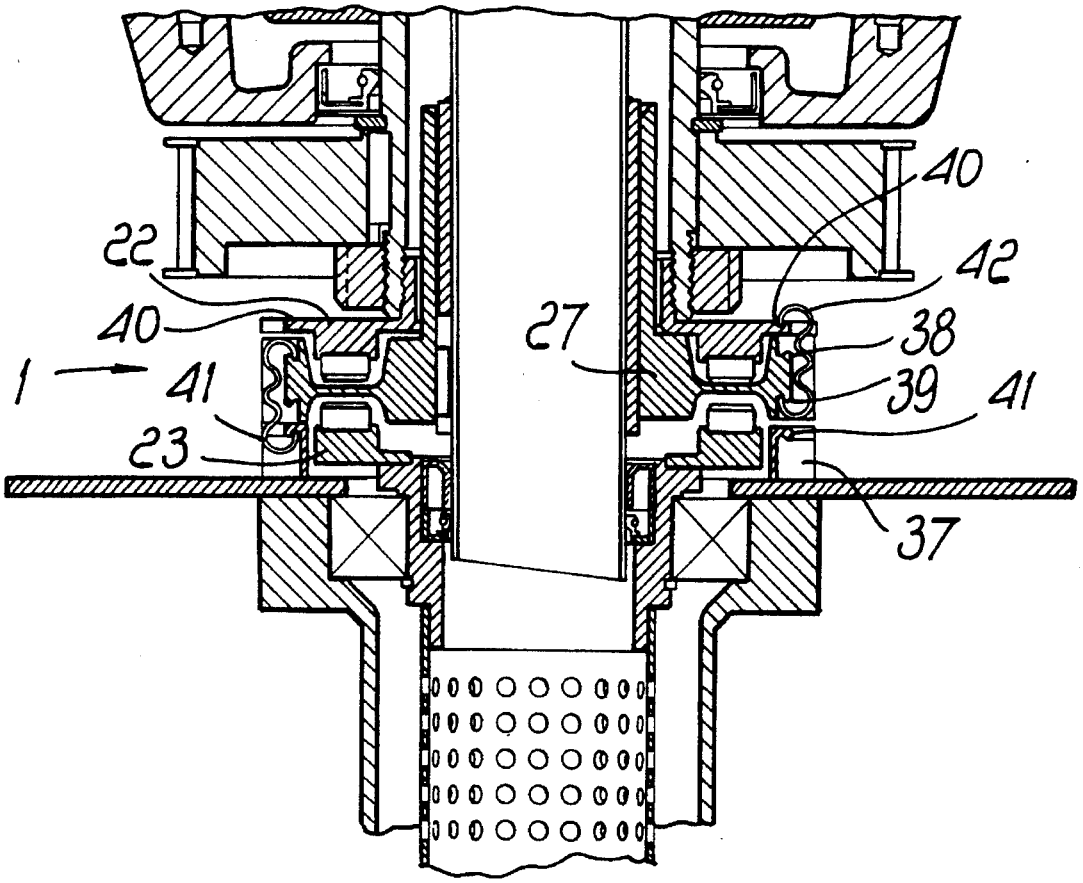
FIG. 2 is a sectional side view, taken along a diametrical plane, of a detail of the unit according to another embodiment of the invention.

FIG. 2 illustrates a unit that allows selection while the machine is not working: in this solution, the collar 26, the flange 22, and a ring 37 that is rigidly coupled to the fixed plate, have respective seats 38, 39, 40, and 41 distributed in an annular fashion for the elastic insertion of shaped hooks 42 for mechanically coupling the collar selectively to the flange 22 or to the fixed ring 37 to rotate or stop the hosiery supporting tube 15.

FIGS. 1 and 2 illustrate, on the left side, the transmission unit with the hosiery supporting tube in fixed mode and, on the right, with the hosiery supporting tube in rotatable mode.

It is thus evident that the invention achieves the intended aim and object, and in particular that the rotary actuation of the perforated tube 18 is obtained without gears, quietly, and with very limited space occupation, and so as to allow to choose if and when the hosiery passage tube is to rotate even without having to stop the machine: it is noted that in view of the limited bulk and of the absence of gears, the transmission unit according to the invention can be used effectively even if the machine is driven by a hollow motor that is coaxial to the cylinder.

The invention thus conceived is susceptible of numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the claims that follow.

What is claimed is:

1. Unit for transmitting motion to a hosiery suction tube in a circular knitting machine having a fixed supporting plate, the unit comprising:

a rotatable cylinder support having a vertical axis;

an internal hosiery passage tube coaxial to the cylinder support; and an underlying perforated tube rotatably coupled to said fixed supporting plate;

said hosiery passage tube provided with means for selectively coupling said hosiery passage tube to said cylinder support and said perforated tube, and said fixed supporting plate, wherein said means stops the rotation or places into rotational movement said hosiery passage tube.

2. Unit according to claim 1, wherein flanges are rigidly coupled below the cylinder support and above the perforated tube, the flanges support pluralities of permanent magnets distributed in an annular fashion forming a ring and which constitute a magnetic coupling between the flanges for rotary actuation of the perforated tube, a collar of high magnetic reluctance material is arranged in an air gap formed between the rings of facing magnets and has means for rotary coupling to the hosiery passage tube, the collar has means for selective coupling to said flanges or to said fixed supporting plate, wherein rotation of said hosiery passage tube is started or stopped.

3. Unit according to claim 2, wherein a central sleeve is rigidly coupled to said collar and is mounted on said hosiery passage tube, said sleeve and said tube have respective mutually facing longitudinal slots for insertion of a rotary coupling tab for longitudinal sliding motion of the collar with respect to the hosiery passage tube.

4. Unit according to claim 2, wherein said collar is peripherally provided with a disk and with a complementary disk between which a plurality of compression springs are clamped, said springs for pushing said disks so as to produce a friction coupling against said flanges to transmit motion to said hosiery passage tube, and two jaws are mounted on said fixed supporting plate for clamping the disk and the complementary disk of the collar to stop said hosiery passage tube.

5. Unit according to claim 2, wherein said collar, said flanges rigidly coupled to the cylinder support, and said fixed supporting plate have seats distributed in an annular fashion for elastic insertion of hooks for mechanical coupling of the collar to said flange or to said supporting plate, wherein rotation of said hosiery passage tube is started or stopped.

6. Unit according to claim 4, wherein said collar, said flanges rigidly coupled to the cylinder support, and said fixed supporting plate have seats distributed in an annular fashion for elastic insertion of hooks for mechanical coupling of the collar to said flange or to said supporting plate, wherein rotation of said hosiery passage tube is started or stopped.

7. A circular knitting machine comprising:

a fixed structure;

a needle cylinder support rotatably supported by said fixed structure;

a hosiery passage tube rotatably supported inside said needle cylinder support;

a perforated tube communicating with said internal hosiery passage tube and rotatably supported by said fixed structure; and a unit for selectively coupling said hosiery passage tube to at least one of said needle cylinder support, said perforated tube, and said fixed structure, wherein said unit stops the rotation or places into rotational movement said hosiery passage tube.

8. The machine of claim 7 wherein said unit comprises:

a magnetic coupling between said needle cylinder support and said perforated tube such that said needle cylinder support and said perforated tube rotate together and such that a gap is formed in said magnetic coupling; and a collar extending in said gap of said magnetic coupling and slidably connected with said hosiery passage tube between selected positions in which said collar is rigidly connected with said supporting structure to stop the rotation of said hosiery passage tube and in which said collar is rigidly connected to said needle cylinder support and said perforated tube to place said hosiery passage tube into rotational movement together with said needle cylinder support and said perforated tube.

9. The machine of claim 8 wherein said unit comprises means for selectively retaining said collar in said selected positions.

* * * * *